US011315484B2

(12) United States Patent
Kim et al.

(10) Patent No.: US 11,315,484 B2
(45) Date of Patent: Apr. 26, 2022

(54) DISPLAY APPARATUS AND METHOD OF DRIVING THE SAME

(71) Applicant: Samsung Display Co., Ltd., Yongin-si (KR)

(72) Inventors: Jinpil Kim, Suwon-si (KR); Hoisik Moon, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 92 days.

(21) Appl. No.: 16/850,647

(22) Filed: Apr. 16, 2020

(65) Prior Publication Data

US 2020/0335033 A1 Oct. 22, 2020

(30) Foreign Application Priority Data

Apr. 17, 2019 (KR) ..... 10-2019-0044742

(51) Int. Cl.
*G09G 3/32* (2016.01)

(52) U.S. Cl.
CPC ..... *G09G 3/32* (2013.01); *G09G 2310/027* (2013.01); *G09G 2320/0626* (2013.01)

(58) Field of Classification Search
CPC ..... G09G 3/32; G09G 2310/027; G09G 2320/0626; G09G 3/3406
See application file for complete search history.

(56) References Cited

U.S. PATENT DOCUMENTS 11,094,268 B1 * 8/2021 Chen ..... G09G 3/3406
2007/0126678 A1 * 6/2007 Shih ..... G09G 3/342 345/89
2008/0002114 A1 * 1/2008 Kim ..... G09G 3/3426 349/113
2009/0179850 A1 * 7/2009 Chen ..... G09G 3/003 345/102
2013/0038639 A1 * 2/2013 Han ..... G09G 3/20 345/690
2015/0219324 A1 * 8/2015 Kim ..... G02F 1/133615 349/58
2017/0148393 A1 * 5/2017 Peana ..... G09G 3/3413
2017/0263195 A1 * 9/2017 Itoi ..... G09G 3/3426
(Continued)

FOREIGN PATENT DOCUMENTS

JP 4527958 B2 8/2010
KR 10-2011-0041256 A 4/2011
(Continued)

*Primary Examiner* — Dmitriy Bolotin
(74) *Attorney, Agent, or Firm* — Lewis Roca Rothgerber Christie LLP

(57) ABSTRACT

A display apparatus includes: a display panel comprising a plurality of pixels configured to display an image based on input image data; a gate driver configured to output a gate signal to the display panel; a data driver configured to output a data voltage to the display panel; a light source part configured to provide light to the display panel and comprising a plurality of light sources; and a light source driver configured to drive the light source part, wherein a first light source of the light source part is configured to output a first luminance in an active period defined by the data voltage being output to the pixel and a second luminance greater than the first luminance in an inactive period defined by the data voltage is not being output to the pixel.

20 Claims, 14 Drawing Sheets

(56) References Cited

U.S. PATENT DOCUMENTS

| | | | | |
|---|---|---|---|---|
| 2017/0277001 | A1* | 9/2017 | Fu | G02F 1/133611 |
| 2020/0051484 | A1* | 2/2020 | Yashiki | G09G 3/3426 |
| 2020/0082781 | A1* | 3/2020 | An | G09G 3/20 |
| 2020/0135146 | A1* | 4/2020 | Lee | G09G 5/006 |
| 2020/0193915 | A1* | 6/2020 | Noh | G09G 3/3275 |
| 2020/0335033 | A1* | 10/2020 | Kim | G09G 3/3674 |

FOREIGN PATENT DOCUMENTS

| | | | |
|---|---|---|---|
| KR | 10-2014-0030468 | A | 3/2014 |
| KR | 10-1482069 | B1 | 1/2015 |
| KR | 10-1511130 | B1 | 4/2015 |
| KR | 10-2018-0039232 | A | 4/2018 |

* cited by examiner

FIG. 8

| GRAYSCALE VALUE / FREQUENCY | 1 | 4 | 8 | 12 | 16 | 20 | 24 | 32 | 48 | 64 | 80 | 96 | 112 | 128 | 144 | 160 | 176 | 192 | 208 | 224 | 240 | 256 |
|---|---|---|---|---|---|---|---|---|---|---|---|---|---|---|---|---|---|---|---|---|---|---|
| 1 | 0.14 | 0.27 | 0.58 | 1.25 | 2.38 | 4.55 | 7.55 | 8.42 | 6.27 | 5.65 | 5.37 | 4.54 | 4.53 | 3.86 | 3.52 | 3.19 | 2.40 | 2.08 | 1.62 | 1.45 | 1.07 | 0.79 |
| 10 | 0.73 | 0.27 | 1.03 | 1.28 | 2.38 | 1.94 | 2.76 | 3.21 | 2.64 | 1.42 | 1.86 | 1.95 | 1.80 | 1.64 | 1.67 | 1.53 | 1.44 | 1.10 | 0.69 | 0.63 | 0.39 | 0.43 |
| 30 | 0.78 | 0.81 | 0.88 | 1.08 | 1.39 | 0.95 | 0.97 | 1.74 | 1.55 | 0.86 | 0.66 | 0.89 | 1.22 | 1.19 | 1.19 | 1.20 | 1.09 | 0.89 | 0.79 | 0.48 | 0.31 | 0.28 |

DISPLAY APPARATUS AND METHOD OF DRIVING THE SAME

CROSS-REFERENCE TO RELATED APPLICATION

This application claims priority to and the benefit of Korean Patent Application No. 10-2019-0044742, filed on Apr. 17, 2019 in the Korean Intellectual Property Office KIPO, the contents of which are herein incorporated by reference in their entireties.

BACKGROUND

1. Field

Aspects of some example embodiments of the present inventive concept relate to a display apparatus and a method of driving the display apparatus.

2. Description of the Related Art

Generally, a display apparatus includes a display panel and a display panel driver. The display panel displays an image based on input image data. The display panel includes a plurality of gate lines, a plurality of data lines and a plurality of pixels. The display panel driver includes a gate driver, a data driver and a driving controller. The gate driver outputs gate signals to the gate lines. The data driver outputs data voltages to the data lines. The driving controller controls the gate driver and the data driver.

The display apparatus may further include a light source part providing a light to the display panel and a light source driver driving the light source part.

The image may be displayed on the display panel in a variable frame rate. When the display panel is driven in a low frame rate, a luminance of the image may be reduced due to a leakage current of the pixels.

The above information disclosed in this Background section is only for enhancement of understanding of the background and therefore the information discussed in this Background section does not necessarily constitute prior art.

SUMMARY

Aspects of some example embodiments of the present inventive concept relate to a display apparatus and a method of driving the display apparatus. For example, some example embodiments of the present inventive concept relate to a display apparatus adjusting a luminance of a light source during a vertical blank period or a holding frame to enhance a display quality of the display apparatus and a method of driving the display apparatus.

Aspects of some example embodiments of the present inventive concept may include a display apparatus configured to adjust a luminance of a light source during a vertical blank period or a holding frame to enhance a display quality.

Aspects of some example embodiments of the present inventive concept may also include a method of driving the display apparatus.

According to some example embodiments of the present inventive concept, a display apparatus includes a display panel, a gate driver, a data driver, a light source part and a light source driver. The display panel includes a plurality of pixels and is configured to display an image based on input image data. The gate driver is configured to output a gate signal to the display panel. The data driver is configured to output a data voltage to the display panel. The light source part is configured to provide light to the display panel and includes a plurality of light sources. The light source driver is configured to drive the light source part. A first light source of the light source part is configured to output a first luminance in an active period when the data voltage is outputted to the pixel and a second luminance greater than the first luminance in an inactive period when the data voltage is not outputted to the pixel.

According to some example embodiments, the display panel may be driven in a frame rate which is variable. When the frame rate is greater than a threshold frame rate, the first light source may be configured to output the first luminance in the active period and the inactive period. When the frame rate is equal to or less than the threshold frame rate, the first light source may be configured to output the first luminance in the active period and the second luminance in the inactive period.

According to some example embodiments, the second luminance may be determined according to the frame rate of the display panel and a grayscale value of the input image data.

According to some example embodiments, the display panel may be driven in a unit of a frame. The frame may include an active period and a vertical blank period. The frame rate of the display panel may be varied according to the input image data. The active period may have a uniform length regardless of the frame rate. As the frame rate decreases, a length of the vertical blank period may increase. The inactive period may be the vertical blank period.

According to some example embodiments, the display apparatus may further include a driving controller configured to control a driving timing of the gate driver and a driving timing of the data driver. When the input image data represents a video image, the driving controller may be configured to determine a frame rate of the display panel to a first frame rate. When the input image data represents a static image, the driving controller may be configured to determine the frame rate of the display panel to a second frame rate less than the first frame rate. The display panel may be driven only in a writing frame including the active period in the first frame rate. The display panel may be driven in the writing frame including the active period and a holding frame not including the active period in the second frame rate. The inactive period may be the holding frame.

According to some example embodiments, the driving controller may include a frequency determiner configured to determine whether the input image data represents a video image or a static image and determine the frame rate, a signal generator configured to generate a first control signal to control the gate driver and a second control signal to control the data driver based on an input control signal and the frame rate and a data compensator configured to generate a data signal based on the input image data and the frame rate.

According to some example embodiments, the light source driver may be configured to determine a duty ratio of a light source driving signal to a first duty ratio such that the first light source outputs the first luminance. The light source driver may be configured to determine the duty ratio of the light source driving signal to a second duty ratio greater than the first duty ratio such that the first light source outputs the second luminance.

According to some example embodiments, when the duty ratio of the light source driving signal is 100%, the light source driver may be configured to determine a light source driving current to a first current such that the first light source outputs the first luminance. When the duty ratio of the light source driving signal is 100%, the light source driver may be configured to determine the light source driving current to a second current greater than the first current such that the first light source outputs the second luminance.

According to some example embodiments, the light source part may include a plurality of mini LEDs. The mini LEDs may be configured to have independent luminances.

According to some example embodiments, the mini LEDs may be configured to have independent duty ratios of light source driving signals.

According to some example embodiments, outermost light sources of the light source part may be configured to output a luminance greater than a luminance of light sources which are not the outermost light sources.

According to some example embodiments, the first light source may be configured to output a gradually increasing luminance in the inactive period.

According to some example embodiments, in a method of driving a display apparatus, the method includes outputting a gate signal to a display panel comprising a plurality of pixels and configured to display an image based on input image data, outputting a data voltage to the display panel and providing light to the display panel using a light source part comprising a plurality of light sources. A first light source of the light source part is configured to output a first luminance in an active period when the data voltage is outputted to the pixel and a second luminance greater than the first luminance in an inactive period when the data voltage is not outputted to the pixel.

According to some example embodiments, the display panel may be driven in a frame rate which is variable. When the frame rate is greater than a threshold frame rate, the first light source may be configured to output the first luminance in the active period and the inactive period. When the frame rate is equal to or less than the threshold frame rate, the first light source may be configured to output the first luminance in the active period and the second luminance in the inactive period.

According to some example embodiments, the second luminance may be determined according to the frame rate of the display panel and a grayscale value of the input image data.

According to some example embodiments, the display panel may be driven in a unit of a frame. The frame may include an active period and a vertical blank period. The frame rate of the display panel may be varied according to the input image data. The active period may have a uniform length regardless of the frame rate. As the frame rate decreases, a length of the vertical blank period may increase. The inactive period may be the vertical blank period.

According to some example embodiments, the method may further include determining a frame rate of the display panel to a first frame rate when the input image data represents a video image and determining the frame rate of the display panel to a second frame rate less than the first frame rate when the input image data represents a static image. The display panel may be driven only in a writing frame including the active period in the first frame rate. The display panel may be driven in the writing frame including the active period and a holding frame not including the active period in the second frame rate. The inactive period may be the holding frame.

According to some example embodiments, a duty ratio of a light source driving signal may have a first duty ratio when the first light source outputs the first luminance. The duty ratio of the light source driving signal may have a second duty ratio greater than the first duty ratio when the first light source outputs the second luminance.

According to some example embodiments, when the duty ratio of the light source driving signal is 100% and the first light source outputs the first luminance, a light source driving current may have a first current. When the duty ratio of the light source driving signal is 100% and the first light source outputs the second luminance, the light source driving current may have a second current greater than the first current.

According to some example embodiments, the first light source may be configured to output a gradually increasing luminance in the inactive period.

According to the display apparatus and the method of driving the display apparatus, the luminance of the light source may be compensated during the vertical blank period or the holding frame to prevent the decrease of the luminance of the image due to the leakage current of the pixel in the low frame rate. Thus, the luminance of the image may be compensated so that the display quality of the display apparatus may be enhanced.

BRIEF DESCRIPTION OF THE DRAWINGS

The above and other features and aspects of some example embodiments of the present inventive concept will become more apparent by describing in more detail example embodiments thereof with reference to the accompanying drawings, in which:

FIG. 8 is a table illustrating a flicker value of the display panel of FIG. 1 determined by a grayscale value of input image data and a frame rate;

DETAILED DESCRIPTION

Hereinafter, aspects of some example embodiments of the present inventive concept will be explained in more detail with reference to the accompanying drawings.

Figure 1:
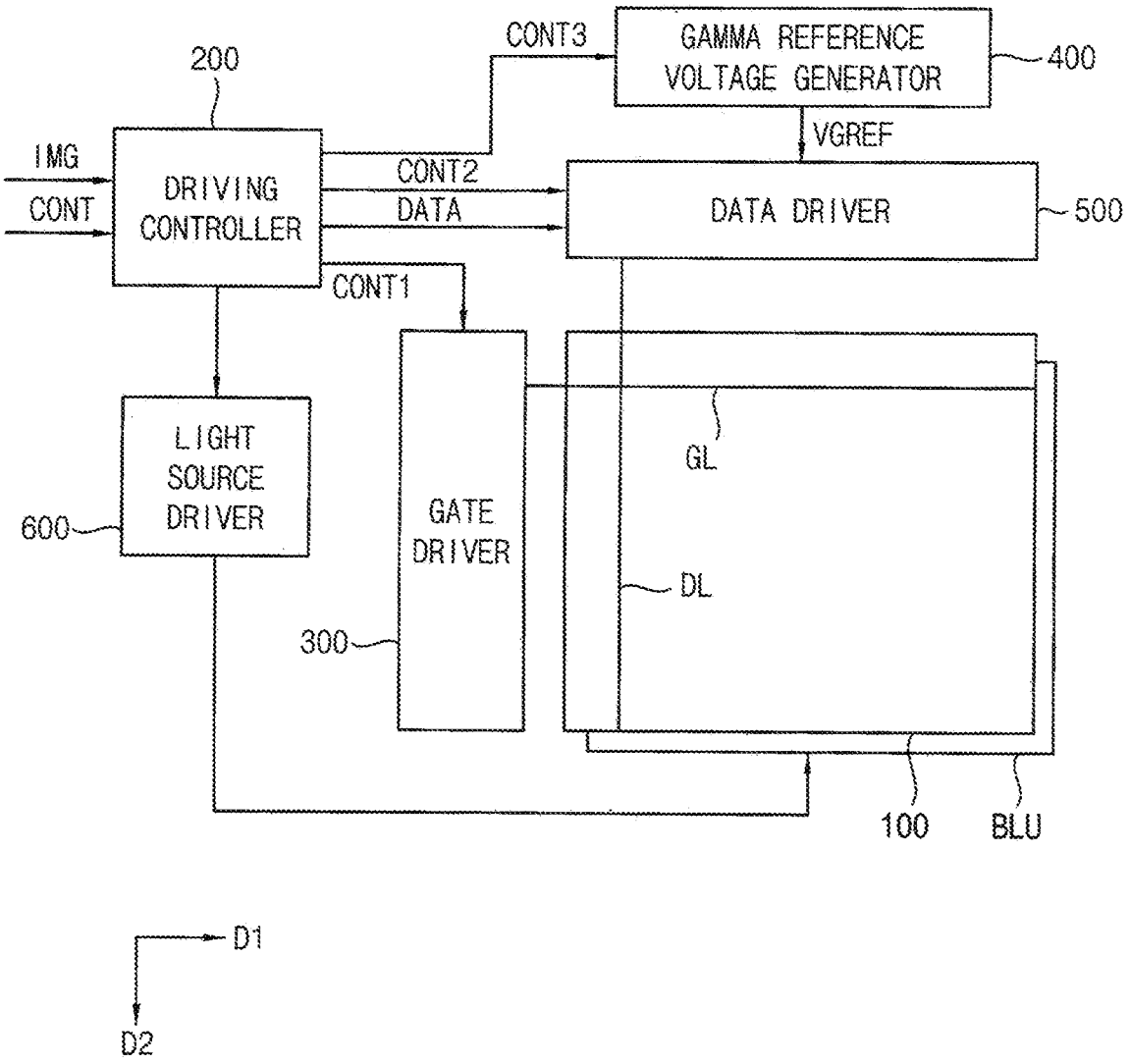
FIG. 1 is a block diagram illustrating a display apparatus according to some example embodiments of the present inventive concept.

FIG. 1 is a block diagram illustrating a display apparatus according to some example embodiments of the present inventive concept.

Referring to FIG. 1, the display apparatus includes a display panel 100 and a display panel driver. The display panel driver includes a driving controller 200, a gate driver 300, a gamma reference voltage generator 400, and a data driver 500. The display apparatus may further include a light source part BLU providing light to the display panel 100 and a light source driver 600 driving the light source part BLU. The display apparatus may further include a host 700 providing input image data to the driving controller 200.

For example, the driving controller 200 and the data driver 500 may be integrally formed. For example, the driving controller 200, the gamma reference voltage generator 400 and the data driver 500 may be integrally formed. For example, the driving controller 200, the gate driver 300, the gamma reference voltage generator 400 and the data driver 500 may be integrally formed.

The display panel 100 includes a plurality of gate lines GL, a plurality of data lines DL and a plurality of pixels electrically connected to the gate lines GL and the data lines DL. The gate lines GL may extend in a first direction D1 and the data lines DL may extend in a second direction D2 crossing the first direction D1. According to some example embodiments, the display panel 100 may be a liquid crystal display panel including a liquid crystal layer.

The driving controller 200 may receive input image data IMG and an input control signal CONT from an external apparatus. For example, the input image data IMG may include red image data, green image data and blue image data. The input image data IMG may include white image data. The input image data IMG may include magenta image data, cyan image data and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 may output the gate signals to the gate lines GL. For example, the gate driver 300 may be mounted on the display panel 100. For example, the gate driver 300 may be integrated on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

According to some example embodiments, the gamma reference voltage generator 400 may be located in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The light source part BLU includes a plurality of light sources. The light source part BLU provides light to the display panel 100. The light sources may be mini LEDs. For example, the mini LEDs may be independently driven. For example, the mini LEDs may have independent luminances.

The light source driver 600 may output a light source driving signal for driving the light source part BLU to the light source part BLU. The light source driver 600 may independently drive the light sources.

Figure 2:
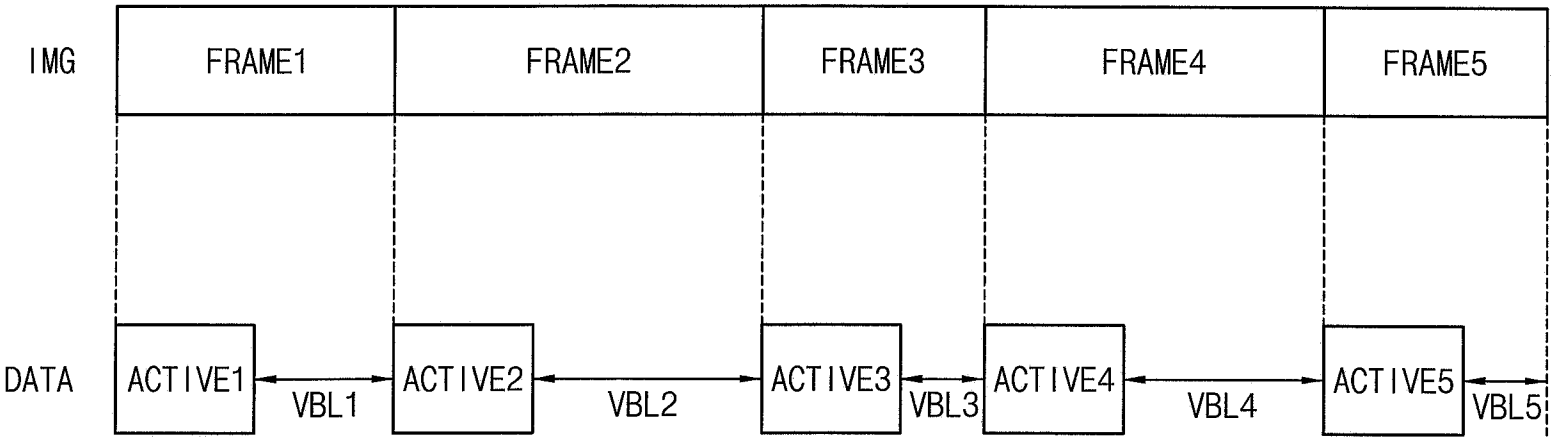
FIG. 2 is a conceptual diagram illustrating frames when a display panel of FIG. 1 displays an image.
Figure 3A:
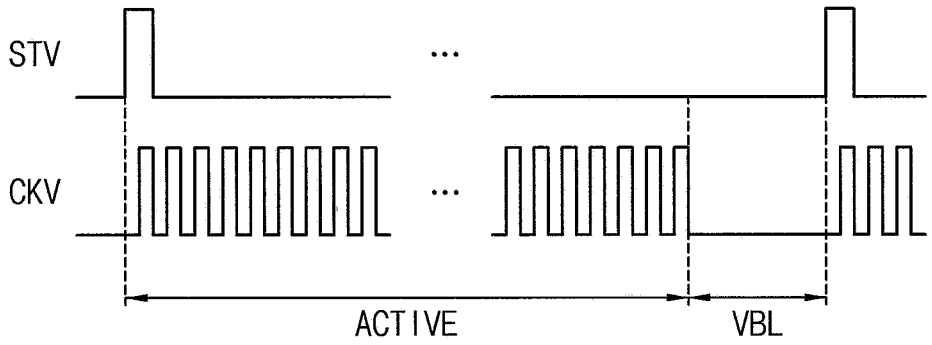
FIG. 3A is a timing diagram illustrating a vertical start signal and a clock signal when a frame rate of the display panel of FIG. 1 is a first frame rate.
Figure 3B:
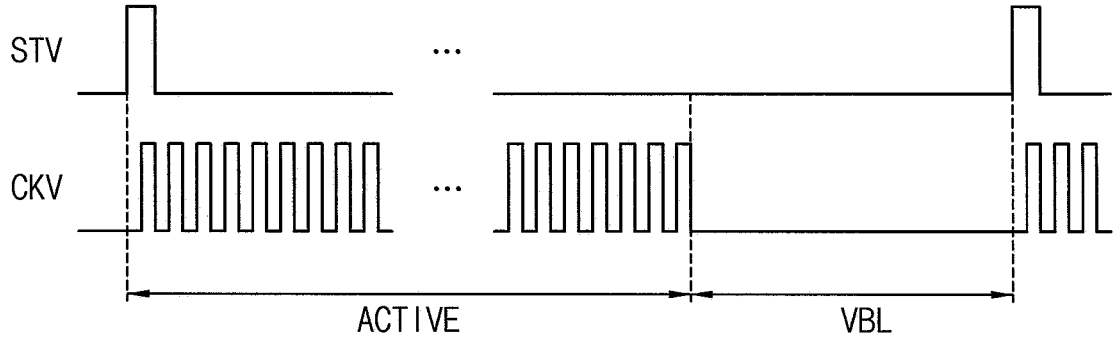
FIG. 3B is a timing diagram illustrating a vertical start signal and a clock signal when a frame rate of the display panel of FIG. 1 is a second frame rate.
Figure 3C:
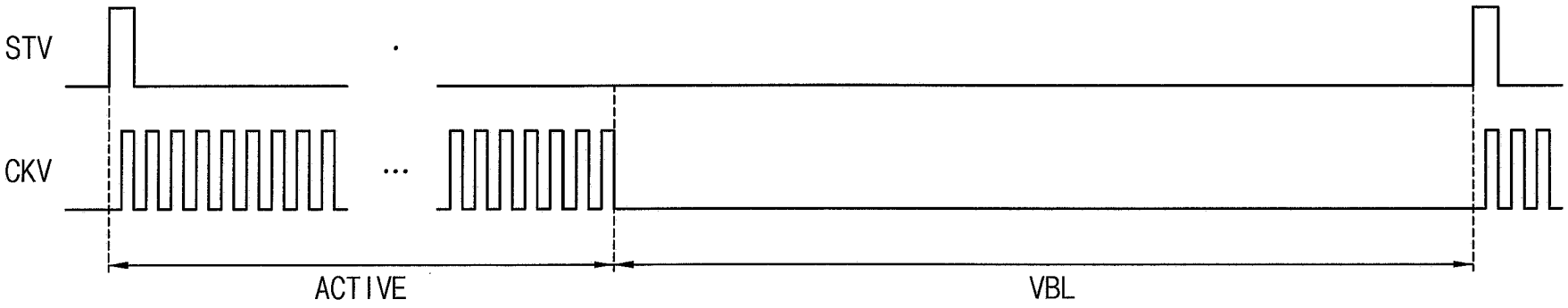
FIG. 3C is a timing diagram illustrating a vertical start signal and a clock signal when a frame rate of the display panel of FIG. 1 is a third frame rate.

FIG. 2 is a conceptual diagram illustrating frames when the display panel 100 of FIG. 1 displays an image. FIG. 3A is a timing diagram illustrating a vertical start signal and a clock signal when a frame rate of the display panel 100 of FIG. 1 is a first frame rate. FIG. 3B is a timing diagram illustrating a vertical start signal and a clock signal when the frame rate of the display panel 100 of FIG. 1 is a second frame rate. FIG. 3C is a timing diagram illustrating a vertical start signal and a clock signal when the frame rate of the display panel 100 of FIG. 1 is a third frame rate.

Referring to FIGS. 1 to 3C, the display panel 100 may display the image in a unit of the frame. The frame may include an active period ACTIVE and a vertical blank period VBL. In the active period ACTIVE, the data voltage may be written to the pixel.

According to some example embodiments, the frame rate of the display panel 100 may be variable. For example, the input image data IMG may include information of the variable frame rate. Thus, the driving controller 200 may determine the frame rate of the display panel 100 according to the information of the variable frame rate included in the input image data IMG.

The active periods ACTIVE1 to ACTIVE5 may have a uniform length regardless of the frame rate. In contrast, lengths of the vertical blank periods VBL1 to VBL5 may be varied according to the frame rate. For example, as the frame rate decreases, the length of the vertical blank period VBL1 to VBL5 may increase.

In FIG. 3A, the frame rate of the display panel 100 may be a first frame rate. The length of the frame may be defined as a duration between adjacent pulses of a vertical start signal STV. The gate signal is generated in synchronous with a pulse of the clock signal CKV and the gate signal is outputted to the gate line. When the gate signal is outputted to the gate line, the data voltage is charged to the pixel. The active period may be defined as a duration when the pulses of the clock signal CKV are outputted. The active period may be also defined as a duration when the data voltages are outputted to the pixels. An inactive period may be defined as a duration when the data voltages are not outputted to the pixels. According to some example embodiments, the inactive period may be the vertical blank period VBL.

In FIG. 3B, the frame rate of the display panel 100 may be a second frame rate less than the first frame rate. A length of the active period ACTIVE in FIG. 3B may be substantially the same as the length of the active period ACTIVE in FIG. 3A. A length of the vertical blank period VBL in FIG. 3B may be greater than the length of the vertical blank period VBL in FIG. 3A.

In FIG. 3C, the frame rate of the display panel 100 may be a third frame rate less than the second frame rate. A length of the active period ACTIVE in FIG. 3C may be substantially the same as the lengths of the active periods ACTIVE in FIGS. 3A and 3B. A length of the vertical blank period VBL in FIG. 3C may be greater than the length of the vertical blank period VBL in FIG. 3B.

Figure 4:
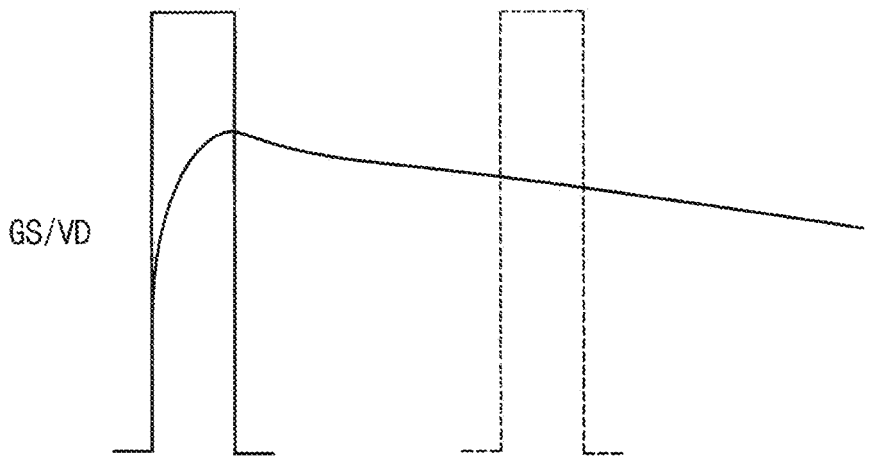
FIG. 4 is a timing diagram illustrating a gate signal outputted from a gate driver of FIG. 1 and a data voltage charged at a pixel of the display panel of FIG. 1.
Figure 5:
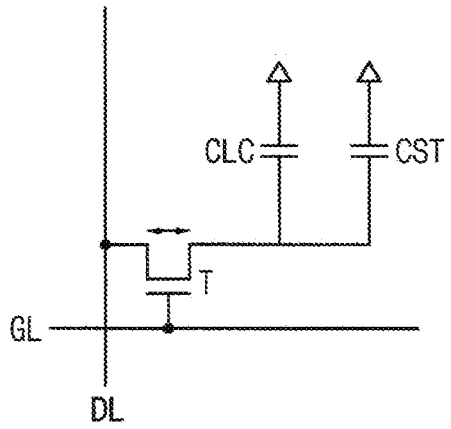
FIG. 5 is a circuit diagram illustrating the pixel of the display panel of FIG. 1.

FIG. 4 is a timing diagram illustrating a gate signal GS outputted from the gate driver 300 of FIG. 1 and a data voltage VD charged at a pixel of the display panel 100 of FIG. 1. FIG. 5 is a circuit diagram illustrating the pixel of the display panel of FIG. 1.

In FIG. 4, the display panel 100 may be driven in a frame rate which is less than a highest frame rate, and the data voltage VD may not mean the voltage outputted from the data driver 500 but the voltage charged at the pixel of the display panel 100.

Referring to FIGS. 1 to 5, the data voltage VD is charged at the pixel in response to a first pulse of the gate signal GS of FIG. 4. The pixel may include a switching element T connected to the gate line GL and the data line DL, a liquid crystal capacitor CLC and a storage capacitor CST which are connected to the switching element T.

As time passes, the data voltage VD charged at the pixel may gradually decrease due to a leakage current of the switching element T. When the frame rate of the display panel 100 is sufficiently high, the data voltage VD is recharged at the pixel in response to a second pulse of the gate signal GS so that a decrease of luminance due to the decrease of the data voltage VD may not be shown to a user.

However, the frame rate may be not sufficiently high in a variable frame rate driving method. Thus, the second pulse of the gate signal GS in FIG. 4 may not be applied to the pixel so that the data voltage VD charged at the pixel may continuously decrease. Accordingly, the decrease of luminance due to the decrease of the data voltage VD may be shown to a user so that a display quality of the display apparatus may be deteriorated.

Figure 6:
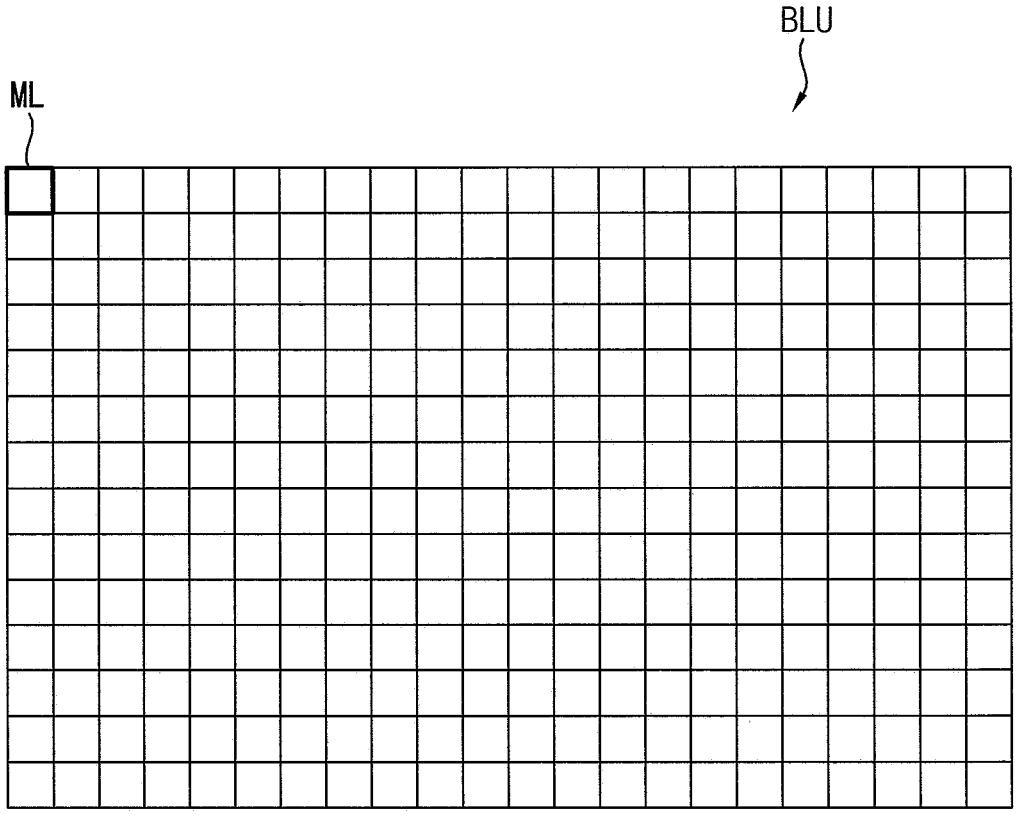
FIG. 6 is a conceptual diagram illustrating a light source part of FIG. 1.
Figure 7:
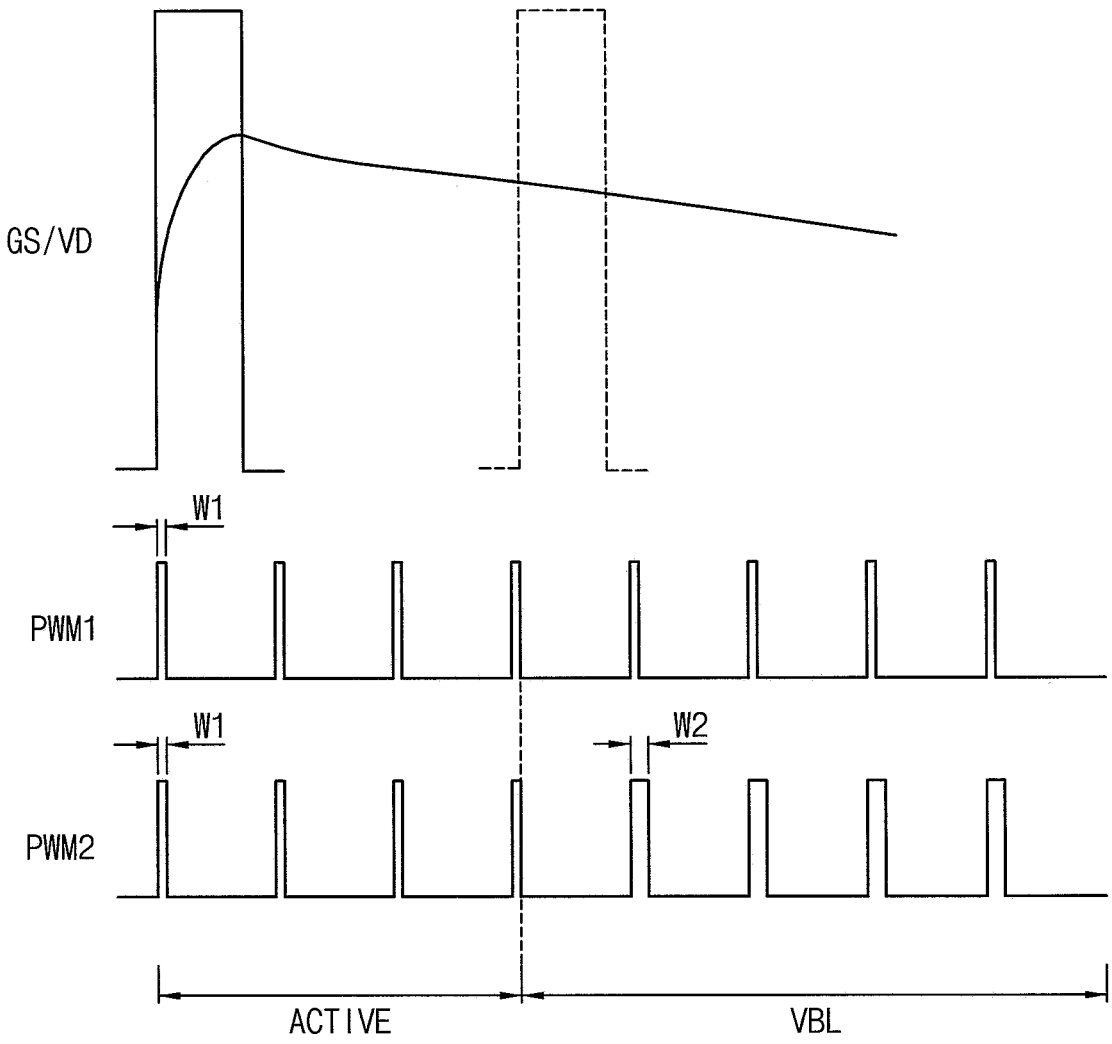
FIG. 7 is a timing diagram illustrating the gate signal outputted from the gate driver of FIG. 1, the data voltage charged at the pixel of the display panel of FIG. 1 and a light source driving signal provided to the light source part of FIG. 1.

FIG. 6 is a conceptual diagram illustrating the light source part BLU of FIG. 1. FIG. 7 is a timing diagram illustrating the gate signal GS outputted from the gate driver of FIG. 1, the data voltage VD charged at the pixel of the display panel 100 of FIG. 1 and a light source driving signal provided to the light source part BLU of FIG. 1.

Referring to FIGS. 1 to 7, the light source part BLU may include a plurality of light sources ML. The light sources ML may be mini LEDs. The mini LEDs may be independently driven. The mini LED may have a size much smaller than a normal LED so that the display apparatus including the mini LEDs may have a much greater resolution than a conventional display apparatus.

According to some example embodiments, a first light source of the light source part BLU outputs a first luminance in the active period when the data voltage VD is outputted to the pixel. The first light source of the light source part BLU outputs a second luminance greater than the first luminance in the inactive period when the data voltage VD is not outputted to the pixel. According to some example embodiments, the inactive period may be the vertical blank period VBL. Herein, the first light source may mean one of the light sources in the light source part BLU.

The light source driver 600 may output a light source driving signal to control a luminance of the light sources of the light source part BLU. For example, the light source driving signal may be a pulse width modulation (PWM) signal. The light source driver 600 may determine a duty ratio of the light source driving signal to a first duty ratio such that the first light source outputs the first luminance. The light source driver 600 may determine the duty ratio of the light source driving signal to a second duty ratio greater than the first duty ratio such that the first light source outputs the second luminance.

As shown in FIG. 7, a conventional light source driver outputs a light source driving signal PWM1 having a same duty ratio W1 in the active period and in the inactive period. Thus, when the frame rate is low, the luminance of the image may decrease due to the leakage current of the switching element T of the pixel.

The light source driver 600 according to some example embodiments, outputs the light source driving signal PWM2 having a first duty ratio W1 in the active period and a second duty ratio W2 greater than the first duty ration W1 in the inactive period. Thus, when the frame rate is low, the decrease of the luminance of the image due to the leakage current of the switching element T of the pixel may be compensated.

For example, when the frame rate is greater than a threshold frame rate, the light source driver 600 may control the first light source to output the first luminance in the active period and the inactive period.

When the frame rate is equal to or less than the threshold frame rate, the light source driver 600 may control the first light source to output the first luminance in the active period and the second luminance in the inactive period.

When the frame rate is greater than the threshold frame rate, the decrease of the luminance due to the leakage current of the switching transistor T may not be shown to the user. In contrast, when the frame rate is greater than a threshold frame rate, the decrease of the luminance due to the leakage current of the switching transistor T may be shown to the user. Thus, the light source driver 600 may determine whether the light source driver 600 operates the compensation of the luminance of the light source or not according to the threshold frame rate.

FIG. 8 is a table illustrating a flicker value of the display panel 100 of FIG. 1 determined by a grayscale value of input image data and a frame rate.

Referring to FIGS. 1 to 8, if the data voltage VD charged at the pixel decreases much, a flicker due to a luminance difference may be shown to a user when the data voltage VD is refreshed at the pixel in a next frame. When the frame rate is low, the flicker may be great. In addition, the flicker may be varied according to the grayscale value of the input image data corresponding to the data voltage VD.

Thus, the second luminance to compensate the decrease of the luminance of the display panel 100 may be determined according to the frame rate of the display panel 100 and the grayscale value of the input image data IMG. When the flicker value according to the frame rate and the grayscale value is relatively great, the second luminance may be relatively great. When the flicker value according to the frame rate and the grayscale value is relatively little, the second luminance may be relatively little.

According to some example embodiments, the luminance of the light source may be compensated in the vertical blank period VBL to compensate the decrease of the luminance of the image due to the leakage current of the pixel in the low frame rate. Thus, the luminance of the image is compensated so that the display quality of the display apparatus may be enhanced.

Figure 9:
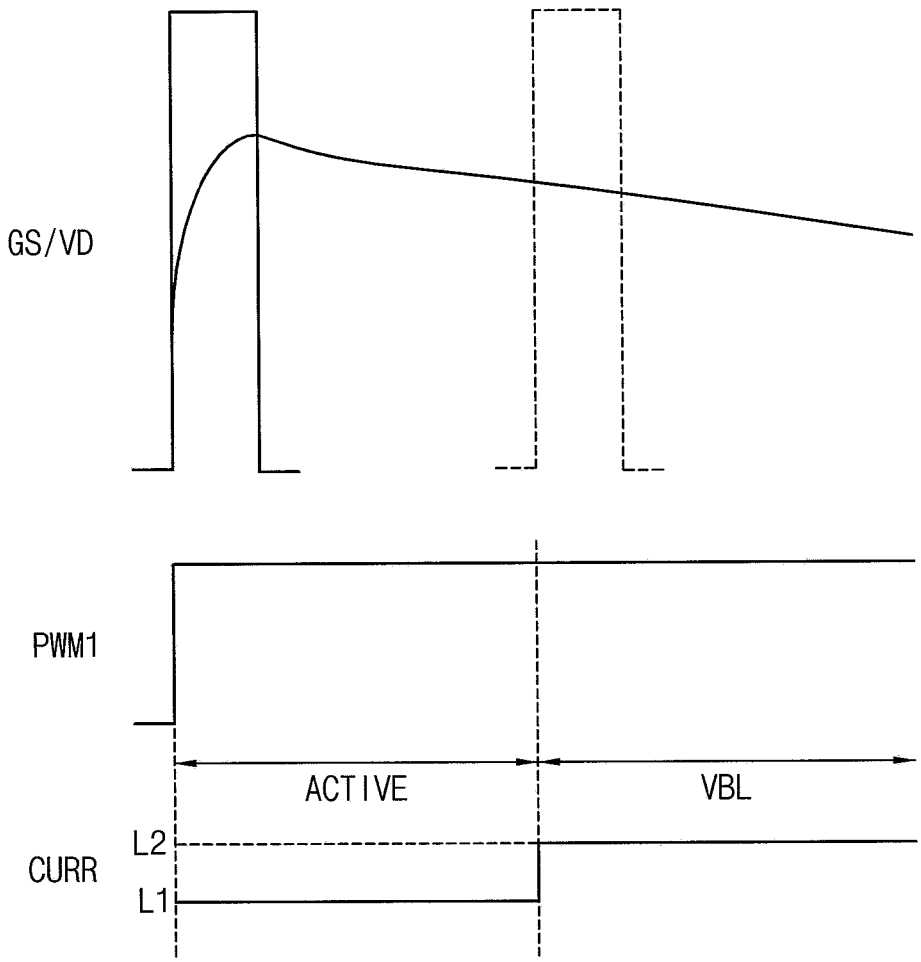
FIG. 9 is a timing diagram illustrating a gate signal outputted from a gate driver of a display apparatus according to some example embodiments of the present inventive concept, a data voltage charged at a pixel of a display panel and a light source driving signal and a light source driving current provided to a light source part.

FIG. 9 is a timing diagram illustrating a gate signal GS outputted from a gate driver 300 of a display apparatus according to some example embodiments of the present inventive concept, a data voltage VD charged at a pixel of a display panel 100 and a light source driving signal PWM1 and a light source driving current CURR provided to a light source part BLU.

The display apparatus and the method of driving the display apparatus according to some example embodiments is substantially the same as the display apparatus and the method of driving the display apparatus of the previous example embodiment explained referring to FIGS. 1 to 8 except for the operation of the light source driver. Thus, the same reference numerals will be used to refer to the same or like parts as those described in the previous example embodiment of FIGS. 1 to 8 and any repetitive explanation concerning the above elements will be omitted.

Referring to FIGS. 1 to 6, 8 and 9, the display apparatus includes a display panel 100 and a display panel driver. The display panel driver includes a driving controller 200, a gate driver 300, a gamma reference voltage generator 400 and a data driver 500. The display apparatus may further include a light source part BLU providing light to the display panel 100 and a light source driver 600 driving the light source part BLU. The display apparatus may further include a host 700 providing input image data to the driving controller 200.

According to some example embodiments, a first light source of the light source part BLU outputs a first luminance in the active period when the data voltage VD is outputted to the pixel. The first light source of the light source part BLU outputs a second luminance greater than the first luminance in the inactive period when the data voltage VD is not outputted to the pixel. According to some example embodiments, the inactive period may be the vertical blank period VBL.

The light source driver 600 may output a light source driving signal to control a luminance of the light sources of the light source part BLU. For example, the light source driving signal may be a pulse width modulation (PWM) signal.

In case when the duty ratio of the light source driving signal PWM1 is 100%, the duty ratio of the light source driving signal PWM1 may not be further increased to increase the luminance of the display panel 100.

Thus, when the duty ratio of the light source driving signal PWM1 is 100%, the light source driver 600 may determine the light source driving current CURR to a first current L1 such that the first light source outputs the first luminance. The light source driver 600 may determine the light source driving current CURR to a second current L2 greater than the first current L1 such that the first light source outputs the second luminance.

As shown in FIG. 7, the light source driver 600 according to some example embodiments, outputs the light source driving signal PWM2 having a first duty ratio W1 in the active period and a second duty ratio W2 greater than the first duty ration W1 in the inactive period. Thus, when the frame rate is low, the decrease of the luminance of the image due to the leakage current of the switching element T of the pixel may be compensated.

In addition, the light source driver 600 according to some example embodiments, may increase the level of the light source driving current CURR, in case when the duty ratio of the light source driving signal PWM1 is 100%, so that the decrease of the luminance of the image due to the leakage current of the switching element T of the pixel may be compensated.

According to some example embodiments, the luminance of the light source may be compensated in the vertical blank period VBL to compensate the decrease of the luminance of the image due to the leakage current of the pixel in the low frame rate. Thus, the luminance of the image is compensated so that the display quality of the display apparatus may be enhanced.

Figure 10:
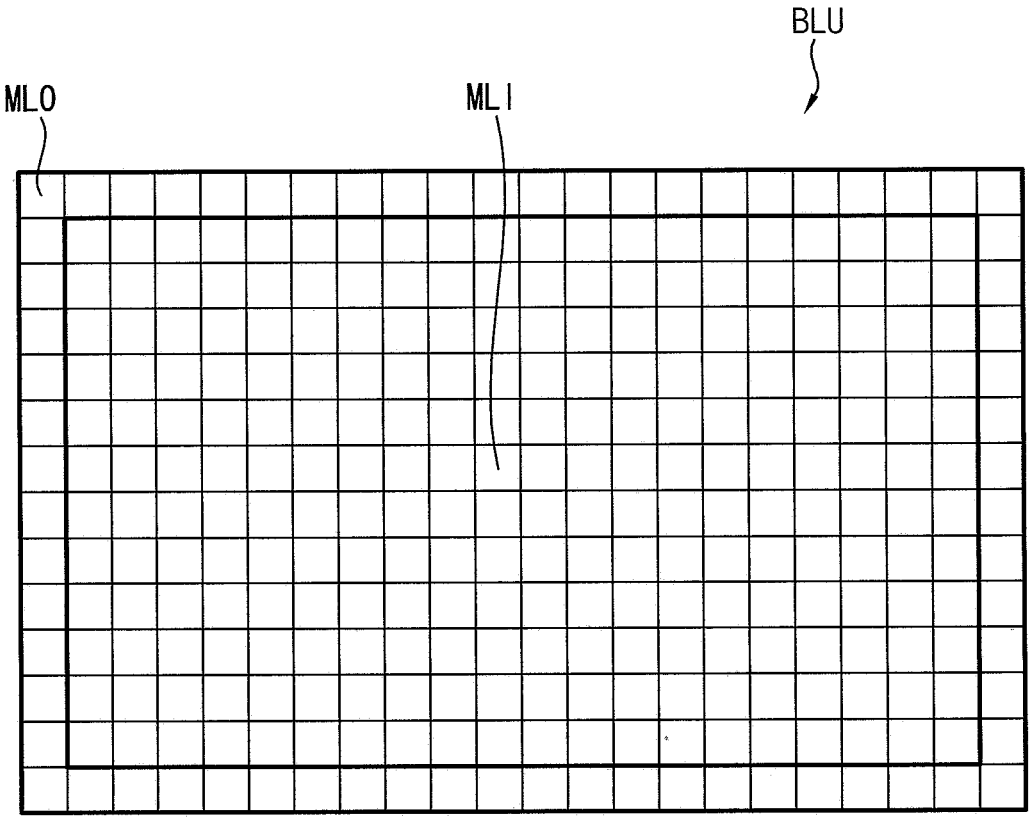
FIG. 10 is a conceptual diagram illustrating a light source part of a display apparatus according to according to some example embodiments of the present inventive concept.
Figure 11:
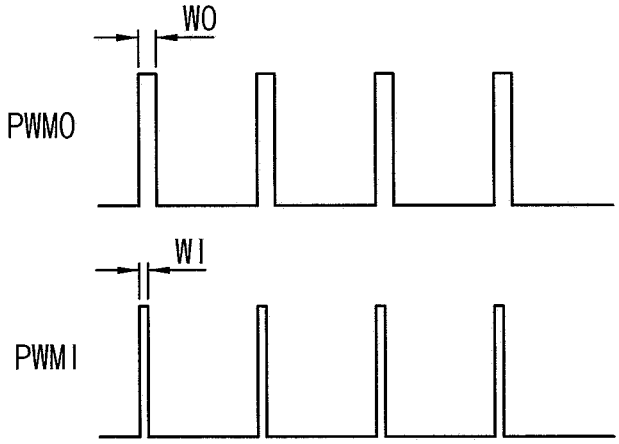
FIG. 11 is a timing diagram illustrating a light source driving signal provided to the light source part of FIG. 10.

FIG. 10 is a conceptual diagram illustrating a light source part BLU of a display apparatus according to according to some example embodiments of the present inventive concept. FIG. 11 is a timing diagram illustrating a light source driving signal PWMO and PWMI provided to the light source part BLU of FIG. 10.

The display apparatus and the method of driving the display apparatus according to the present example embodiment is substantially the same as the display apparatus and the method of driving the display apparatus of the previous example embodiment explained referring to FIGS. 1 to 8 except for the operation of the light source driver. Thus, the same reference numerals will be used to refer to the same or like parts as those described in the previous example embodiment of FIGS. 1 to 8 and any repetitive explanation concerning the above elements will be omitted.

Referring to FIGS. 1 to 8, 10 and 11, the display apparatus includes a display panel 100 and a display panel driver. The display panel driver includes a driving controller 200, a gate driver 300, a gamma reference voltage generator 400 and a data driver 500. The display apparatus may further include a light source part BLU providing light to the display panel 100 and a light source driver 600 driving the light source part BLU. The display apparatus may further include a host 700 providing input image data to the driving controller 200.

The light source part BLU may include a plurality of light sources. The light sources may be mini LEDs.

The light source part BLU may include an outermost light source MLO located at an outermost position of the light source part BLU and an inner light source MLI which is not the outermost light source MLO.

For the same grayscale value, the outermost light source MLO of the light source part BLU may output a luminance greater than a luminance of the light sources MLI which are not the outermost light source MLO. A luminance of an edge portion of the display panel 100 may have a low luminance due to a structure of the display apparatus or a small number of adjacent light sources compared to the inner light source MLI so that the display quality may be deteriorated.

Thus, the outermost light source MLO of the light source part BLU outputs the luminance greater than the luminance of the light sources MLI which are not the outermost light source MLO so that the display quality of the display panel 100 may be enhanced.

For example, the outermost light source MLO may mean the light sources located at an outermost portion along a first side, a second side, a third side and a fourth side of the light source part BLU.

The light source driver 600 may control a pulse width WO of the light source driving signal PWMO applied to the outermost light source MLO to be greater than a pulse with of the light source driving signal PWMI applied to the inner light source MLI.

The operation of the light source driver 600 of FIG. 7 may be applied to the present example embodiment. In addition, the operation of the light source driver 600 of FIG. 9 may be applied to the present example embodiment.

As shown in FIG. 7, the light source driver 600 according to some example embodiments, outputs the light source driving signal PWM2 having a first duty ratio W1 in the active period and a second duty ratio W2 greater than the first duty ration W1 in the inactive period. Thus, when the frame rate is low, the decrease of the luminance of the image due to the leakage current of the switching element T of the pixel may be compensated.

Figure 12:
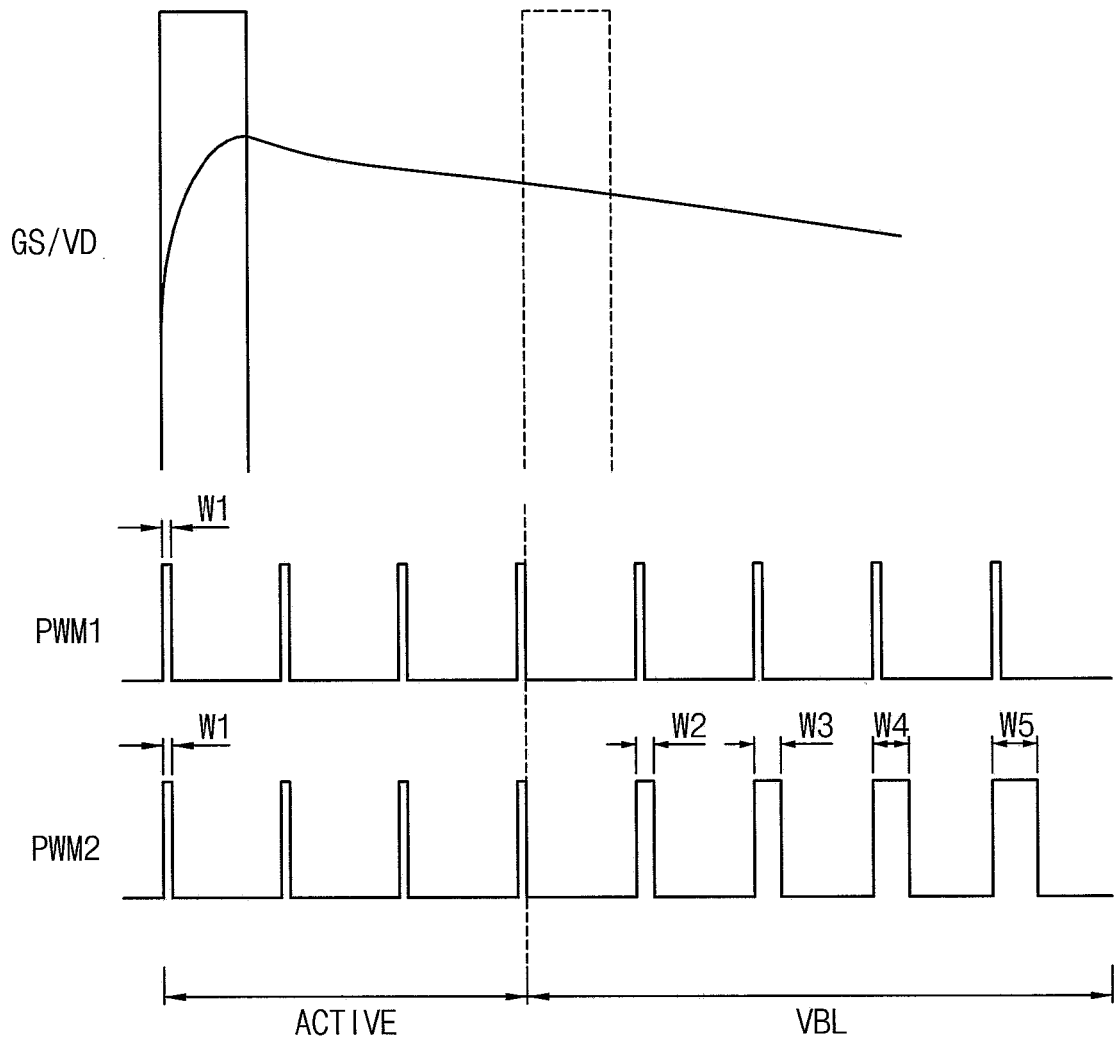
FIG. 12 is a timing diagram illustrating a gate signal outputted from a gate driver of a display apparatus according to some example embodiments of the present inventive concept, a data voltage charged at a pixel of a display panel and a light source driving signal provided to a light source part.

FIG. 12 is a timing diagram illustrating a gate signal GS outputted from a gate driver 300 of a display apparatus according to an example embodiment of the present inventive concept, a data voltage VD charged at a pixel of a display panel 100 and a light source driving signal PWM2 provided to a light source part 600.

The display apparatus and the method of driving the display apparatus according to the present example embodiment is substantially the same as the display apparatus and the method of driving the display apparatus of the previous example embodiment explained referring to FIGS. 1 to 8 except for the operation of the light source driver. Thus, the same reference numerals will be used to refer to the same or like parts as those described in the previous example embodiment of FIGS. 1 to 8 and any repetitive explanation concerning the above elements will be omitted.

Referring to FIGS. 1 to 6, 8 and 12, the display apparatus includes a display panel 100 and a display panel driver. The display panel driver includes a driving controller 200, a gate driver 300, a gamma reference voltage generator 400 and a data driver 500. The display apparatus may further include a light source part BLU providing light to the display panel 100 and a light source driver 600 driving the light source part BLU. The display apparatus may further include a host 700 providing input image data to the driving controller 200.

According to some example embodiments, a first light source of the light source part BLU outputs a first luminance in the active period when the data voltage VD is outputted to the pixel. The first light source of the light source part BLU outputs a second luminance greater than the first luminance in the inactive period when the data voltage VD is not outputted to the pixel. According to some example embodiments, the inactive period may be the vertical blank period VBL.

According to some example embodiments, the first light source may output gradually increasing luminance in the inactive period. As shown in FIG. 12, the data voltage VD may gradually decrease as time passes. Thus, when the luminance of the light source is gradually increased in the inactive period, the display quality of the display apparatus may be effectively compensated.

The light source driver 600 outputs the light source driving signal PWM2 having a first duty ratio W1 in the active period, a second duty ratio W2 greater than the first duty ration W1, a third duty ratio W3 greater than the second duty ration W2, a fourth duty ratio W4 greater than the third duty ration W3 and a fifth duty ratio W5 greater than the fourth duty ration W4 in the inactive period. Thus, when the frame rate is low, the decrease of the luminance of the image due to the leakage current of the switching element T of the pixel may be compensated.

According to some example embodiments, the luminance of the light source may be compensated in the vertical blank period VBL to compensate the decrease of the luminance of the image due to the leakage current of the pixel in the low frame rate. Thus, the luminance of the image is compensated so that the display quality of the display apparatus may be enhanced.

Figure 13:
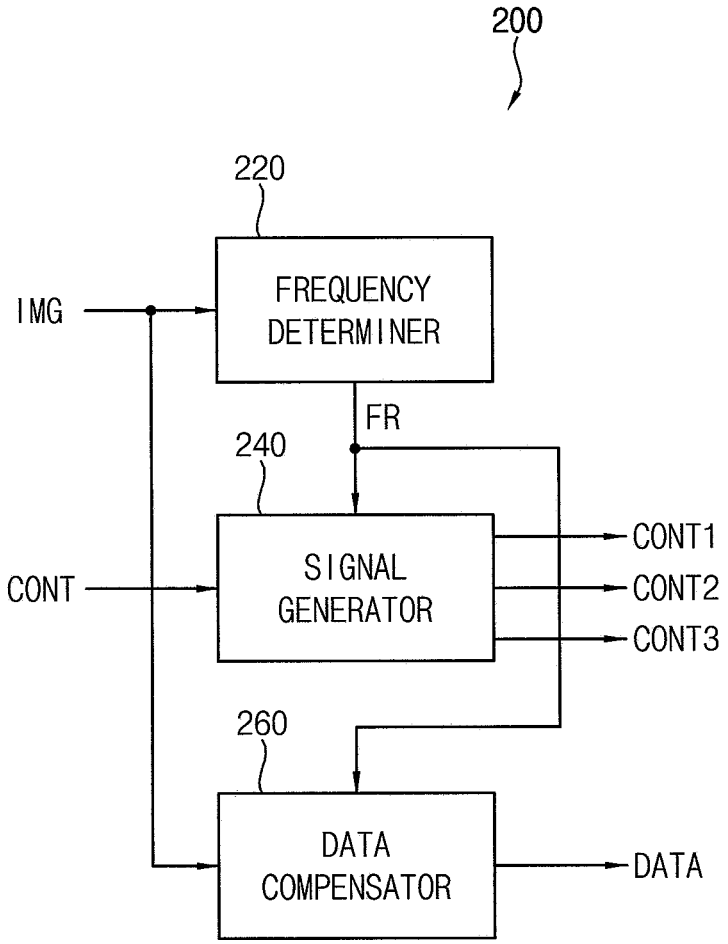
FIG. 13 is a block diagram illustrating a driving controller of a display apparatus according to some example embodiments of the present inventive concept.
Figure 14:
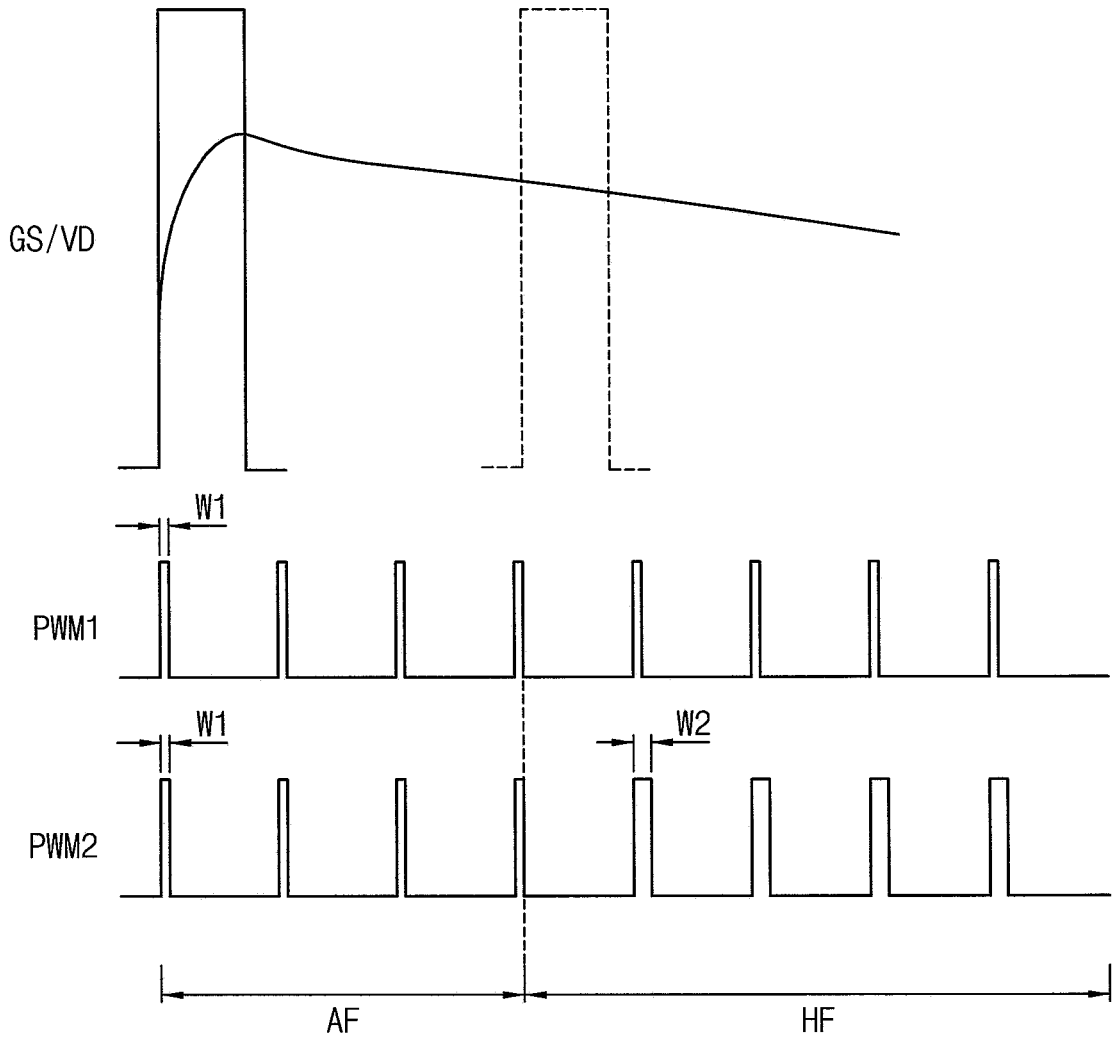
FIG. 14 is a timing diagram illustrating a gate signal outputted from a gate driver of the display apparatus of FIG. 13, a data voltage charged at a pixel of a display panel and a light source driving signal provided to a light source part.

FIG. 13 is a block diagram illustrating a driving controller 200 of a display apparatus according to an example embodiment of the present inventive concept. FIG. 14 is a timing diagram illustrating a gate signal GS outputted from a gate driver 300 of the display apparatus of FIG. 13, a data voltage VD charged at a pixel of a display panel 100 and a light source driving signal PWM2 provided to a light source part 600.

Referring to FIGS. 1, 4 to 6, 8, 13 and 12, the display apparatus includes a display panel 100 and a display panel driver. The display panel driver includes a driving controller 200, a gate driver 300, a gamma reference voltage generator 400 and a data driver 500. The display apparatus may further include a light source part BLU providing light to the display panel 100 and a light source driver 600 driving the light source part BLU. The display apparatus may further include a host 700 providing input image data to the driving controller 200.

The driving controller 200 may determine whether the input image data IMG represents a video image or a static image. When the input image data IMG represents the video image, the driving controller 200 determines the frame rate FR of the display panel 100 to a first frame rate. When the input image data IMG represents the static image, the driving controller 200 determines the frame rate FR of the display panel 100 to a second frame rate less than the first frame rate.

The driving controller 200 may include a frequency determiner 220, a signal generator 240 and a data compensator 260.

The frequency determiner 220 may determine the frame rate FR of the display apparatus based on the input image data IMG. When the input image data IMG represents a video image, the frame rate FR may be relatively high. When the input image data IMG represents a static image, the frame rate FR may be relatively low.

The frequency determiner 220 may determine a low frequency driving mode and a normal driving mode based on the input image data IMG. For example, when the input image data IMG represents a video image, the frequency determiner 220 may drive the display apparatus in the normal driving mode. For example, when the input image data IMG represents a static image, the frequency determiner 220 may drive the display apparatus in the low frequency driving mode.

In addition, the frequency determiner 220 may determine the low frequency driving mode and the normal driving mode based on an input mode of the display apparatus. For example, when the input mode of the display apparatus is Always On Mode, the frequency determiner 220 may drive the display apparatus in the low frequency driving mode.

The display panel 100 may be driven in a unit of frame. The display panel 100 may be refreshed in every frame in the normal driving mode. Thus, the normal driving mode includes only writing frames AF in which the data is written in the pixel.

The display panel 100 may be refreshed in the frequency of the low frequency driving mode in the low frequency driving mode. Thus, the low frequency driving mode includes the writing frames AF in which the data is written in the pixel and holding frames HF in which the written data is maintained without writing the data in the pixel.

For example, when the frequency of the normal driving mode is 60 Hz and the frequency of the low frequency driving mode is 1 Hz, the low frequency driving mode includes one writing frame AF and fifty nine holding frames HF in a second. For example, when the frequency of the normal driving mode is 60 Hz and the frequency of the low frequency driving mode is 1 Hz, fifty nine continuous holding frames HF are located between two adjacent writing frames AF.

For example, when the frequency of the normal driving mode is 60 Hz and the frequency of the low frequency driving mode is 10 Hz, the low frequency driving mode includes ten writing frame AF and fifty holding frames HF in a second. For example, when the frequency of the normal driving mode is 60 Hz and the frequency of the low frequency driving mode is 10 Hz, five continuous holding frames HF are located between two adjacent writing frames AF.

The frequency determiner 220 may output the frame rate FR to the signal generator 240 and the data compensator 260.

The signal generator 240 may generate the first control signal CONT1 to control an operation of the gate driver 300 based on the input control signal CONT and the frame rate FR and output the first control signal CONT1 to the gate driver 300. The signal generator 240 may generate the second control signal CONT2 to control an operation of the data driver 500 based on the input control signal CONT and the frame rate FR and output the second control signal CONT2 to the data driver 500. The signal generator 240 may generate the third control signal CONT3 to control an operation of the gamma reference voltage generator 400 based on the input control signal CONT and the frame rate FR and output the third control signal CONT3 to the gamma reference voltage generator 400.

The data compensator 260 may generate the data signal DATA based on the input image data IMG and the frame rate FR and output the data signal DATA to the data driver 500. The data compensator 260 may compensate the input image data IMG to generate the data signal DATA. For example, the data compensator 260 may operate adaptive color correction using a gamma curve. For example, the data compensator 260 may operate dynamic capacitance compensation for compensating present frame data using previous frame data and the present frame data.

According to some example embodiments, a first light source of the light source part BLU outputs a first luminance in the active period when the data voltage VD is outputted to the pixel. The first light source of the light source part BLU outputs a second luminance greater than the first luminance in the inactive period when the data voltage VD is not outputted to the pixel. According to some example embodiments, the active period may be the writing frame AF and the inactive period may be the holding frame HF.

The light source driver 600 may output a light source driving signal to control a luminance of the light sources of the light source part BLU. For example, the light source driving signal may be a pulse width modulation (PWM) signal. The light source driver 600 may determine a duty ratio of the light source driving signal to a first duty ratio such that the first light source outputs the first luminance. The light source driver 600 may determine the duty ratio of the light source driving signal to a second duty ratio greater than the first duty ratio such that the first light source outputs the second luminance.

As shown in FIG. 14, a conventional light source driver outputs a light source driving signal PWM1 having a same duty ratio W1 in the active period and in the inactive period. Thus, when the frame rate is low, the luminance of the image may decrease due to the leakage current of the switching element T of the pixel.

The light source driver 600 according to some example embodiments, outputs the light source driving signal PWM2 having a first duty ratio W1 in the active period AF and a second duty ratio W2 greater than the first duty ration W1 in the inactive period HF. Thus, when the frame rate is low, the decrease of the luminance of the image due to the leakage current of the switching element T of the pixel may be compensated.

For example, when the frame rate is greater than a threshold frame rate, the light source driver 600 may control the first light source to output the first luminance in the active period AF and the inactive period HF.

When the frame rate is equal to or less than the threshold frame rate, the light source driver 600 may control the first light source to output the first luminance in the active period AF and the second luminance in the inactive period HF.

According to some example embodiments, the luminance of the light source may be compensated in the holding frame HF to compensate the decrease of the luminance of the image due to the leakage current of the pixel in the low frame rate. Thus, the luminance of the image is compensated so that the display quality of the display apparatus may be enhanced.

Figure 15:
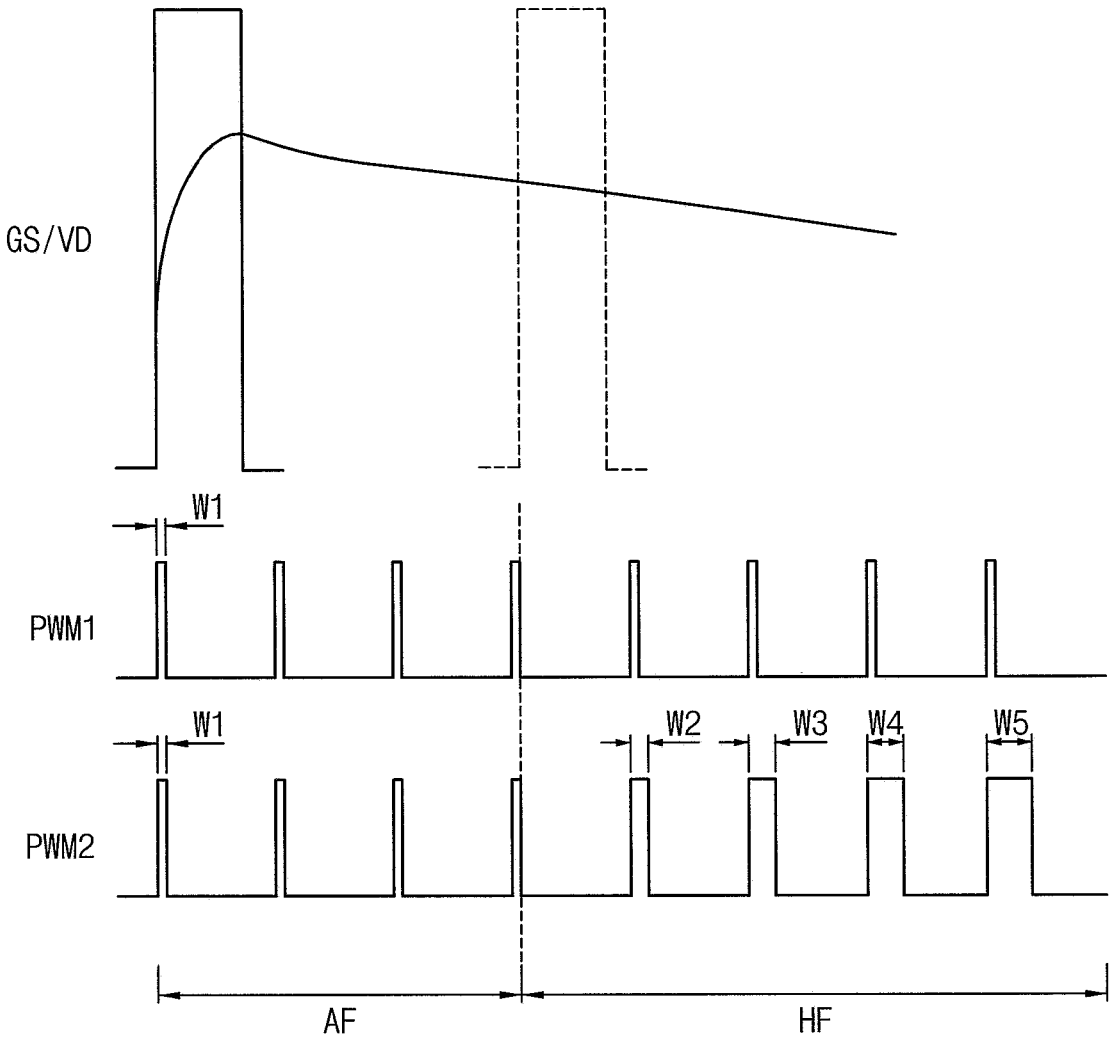
FIG. 15 is a timing diagram illustrating a gate signal outputted from a gate driver of a display apparatus according to some example embodiments of the present inventive concept, a data voltage charged at a pixel of a display panel and a light source driving signal provided to a light source part.

FIG. 15 is a timing diagram illustrating a gate signal GS outputted from a gate driver 300 of a display apparatus according to an example embodiment of the present inventive concept, a data voltage VD charged at a pixel of a display panel 100 and a light source driving signal PWM2 provided to a light source part 600.

The display apparatus and the method of driving the display apparatus according to the present example embodiment is substantially the same as the display apparatus and the method of driving the display apparatus of the previous example embodiment explained referring to FIGS. 13 and 14 except for the operation of the light source driver. Thus, the same reference numerals will be used to refer to the same or like parts as those described in the previous example embodiment of FIGS. 13 and 14 and any repetitive explanation concerning the above elements will be omitted.

Referring to FIGS. 1, 4 to 6, 8, 13 and 15, the display apparatus includes a display panel 100 and a display panel driver. The display panel driver includes a driving controller 200, a gate driver 300, a gamma reference voltage generator 400 and a data driver 500. The display apparatus may further include a light source part BLU providing light to the display panel 100 and a light source driver 600 driving the light source part BLU. The display apparatus may further include a host 700 providing input image data to the driving controller 200.

According to some example embodiments, a first light source of the light source part BLU outputs a first luminance in the active period when the data voltage VD is outputted to the pixel. The first light source of the light source part BLU outputs a second luminance greater than the first luminance in the inactive period when the data voltage VD is not outputted to the pixel. According to some example embodiments, the active period may be the writing frame AF and the inactive period may be the holding frame HF.

According to some example embodiments, the first light source may output gradually increasing luminance in the inactive period HF. As shown in FIG. 15, the data voltage VD may gradually decrease as time passes. Thus, when the luminance of the light source is gradually increased in the inactive period HF, the display quality of the display apparatus may be effectively compensated.

The light source driver 600 outputs the light source driving signal PWM2 having a first duty ratio W1 in the active period AF, a second duty ratio W2 greater than the first duty ration W1, a third duty ratio W3 greater than the second duty ration W2, a fourth duty ratio W4 greater than the third duty ration W3 and a fifth duty ratio W5 greater than the fourth duty ration W4 in the inactive period HF. Thus, when the frame rate is low, the decrease of the luminance of the image due to the leakage current of the switching element T of the pixel may be compensated.

According to some example embodiments, the luminance of the light source may be compensated in the holding frame HF to compensate the decrease of the luminance of the image due to the leakage current of the pixel in the low frame rate. Thus, the luminance of the image is compensated so that the display quality of the display apparatus may be enhanced.

According to the present inventive concept as explained above, the display quality of the display apparatus may be enhanced.

The foregoing is illustrative of the present inventive concept and is not to be construed as limiting thereof. Although aspects of some example embodiments of the present inventive concept have been described, those skilled in the art will readily appreciate that many modifications are possible in the example embodiments without materially departing from the novel teachings and characteristics of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific example embodiments disclosed, and that modifications to the disclosed example embodiments, as well as other example embodiments, are intended to be included within the scope of the appended claims. The present inventive concept is defined by the following claims, with equivalents of the claims to be included therein.

What is claimed is:

1. A display apparatus comprising:

a display panel comprising a plurality of pixels configured to display an image based on input image data;

a gate driver configured to output a gate signal to the display panel;

a data driver configured to output a data voltage to the display panel;

a light source part configured to provide light to the display panel and comprising a plurality of light sources; and a light source driver configured to drive the light source part, wherein a first light source of the light source part is configured to output a first luminance in an active period defined by the data voltage being output to the pixel and a second luminance greater than the first luminance in an inactive period defined by the data voltage is not being output to the pixel, and wherein the display panel is configured to be driven in a frame rate which is variable and to output the first luminance or the second luminance based on the frame rate and the active and inactive periods.

2. The display apparatus of claim 1, wherein when the frame rate is greater than a threshold frame rate, the first light source is configured to output the first luminance in the active period and the inactive period, and wherein when the frame rate is equal to or less than the threshold frame rate, the first light source is configured to output the first luminance in the active period and the second luminance in the inactive period.

3. The display apparatus of claim 2, wherein the second luminance is determined according to the frame rate of the display panel and a grayscale value of the input image data.

4. The display apparatus of claim 1, wherein the display panel is configured to be driven in a unit of a frame, wherein the frame comprises the active period and a vertical blank period, wherein a frame rate of the display panel is varied according to the input image data, wherein the active period has a uniform length regardless of the frame rate, wherein as the frame rate decreases, a length of the vertical blank period increases, and wherein the inactive period is the vertical blank period.

5. The display apparatus of claim 1, further comprising a driving controller configured to control a driving timing of the gate driver and a driving timing of the data driver, wherein the driving controller is configured to set a frame rate of the display panel to a first frame rate based on the input image data representing a video image, and wherein the driving controller is configured to set the frame rate of the display panel to a second frame rate less than the first frame rate based on the input image data representing a static image, wherein the display panel is configured to be driven only in a writing frame including the active period in the first frame rate, wherein the display panel is configured to be driven in the writing frame including the active period and a holding frame not including the active period in the second frame rate, and wherein the inactive period is the holding frame.

6. The display apparatus of claim 5, wherein the driving controller comprises:

a frequency determiner configured to determine whether the input image data represents a video image or a static image and determine the frame rate;

a signal generator configured to generate a first control signal to control the gate driver and a second control signal to control the data driver based on an input control signal and the frame rate; and a data compensator configured to generate a data signal based on the input image data and the frame rate.

7. The display apparatus of claim 1, wherein the light source driver is configured to determine a duty ratio of a light source driving signal to a first duty ratio such that the first light source outputs the first luminance, and wherein the light source driver is configured to determine the duty ratio of the light source driving signal to a second duty ratio greater than the first duty ratio such that the first light source outputs the second luminance.

8. The display apparatus of claim 1 wherein the light source driver is configured to determine a light source driving current to a first current such that the first light source outputs the first luminance based on a duty ratio of the light source driving signal being 100%, and wherein the light source driver is configured to determine the light source driving current to a second current greater than the first current such that the first light source outputs the second luminance based on the duty ratio of the light source driving signal being 100%.

9. The display apparatus of claim 1, wherein the light source part comprises a plurality of mini LEDs, and wherein the mini LEDs are configured to have independent luminances.

10. The display apparatus of claim 9, wherein the mini LEDs are configured to have independent duty ratios of light source driving signals.

11. The display apparatus of claim 1, wherein outermost light sources of the light source part are configured to output a luminance greater than a luminance of light sources which are not the outermost light sources.

12. The display apparatus of claim 1, wherein the first light source is configured to output a gradually increasing luminance in the inactive period.

13. A method of driving a display apparatus, the method comprising:

outputting a gate signal to a display panel comprising a plurality of pixels configured to display an image based on input image data;

outputting a data voltage to the display panel;

providing light to the display panel using a light source part comprising a plurality of light sources, wherein a first light source of the light source part is configured to output a first luminance in an active period defined by the data voltage being output to the pixel and a second luminance greater than the first luminance in an inactive period defined by the data voltage is not being output to the pixel, and wherein the display panel is configured to be driven in a frame rate which is variable; and outputting the first luminance or the second luminance based on the frame rate and the active and inactive periods.

14. The method of claim 13, wherein when the frame rate is greater than a threshold frame rate, the first light source is configured to output the first luminance in the active period and the inactive period, and wherein when the frame rate is equal to or less than the threshold frame rate, the first light source is configured to output the first luminance in the active period and the second luminance in the inactive period.

15. The method of claim 14, wherein the second luminance is determined according to the frame rate of the display panel and a grayscale value of the input image data.

16. The method of claim 13, wherein the display panel is driven in a unit of a frame, wherein the frame comprises the active period and a vertical blank period, wherein a frame rate of the display panel is varied according to the input image data, wherein the active period has a uniform length regardless of the frame rate, wherein as the frame rate decreases, a length of the vertical blank period increases, and wherein the inactive period is the vertical blank period.

17. The method of claim 13, further comprising:

determining a frame rate of the display panel to a first frame rate when the input image data represents a video image; and determining the frame rate of the display panel to a second frame rate less than the first frame rate when the input image data represents a static image, and wherein the display panel is driven only in a writing frame including the active period in the first frame rate, wherein the display panel is driven in the writing frame including the active period and a holding frame not including the active period in the second frame rate, and wherein the inactive period is the holding frame.

18. The method of claim 13, wherein a duty ratio of a light source driving signal has a first duty ratio when the first light source outputs the first luminance, and wherein the duty ratio of the light source driving signal has a second duty ratio greater than the first duty ratio when the first light source outputs the second luminance.

19. The method of claim 13 wherein when a duty ratio of the light source driving signal is 100% and the first light source outputs the first luminance, a light source driving current has a first current, and wherein when the duty ratio of the light source driving signal is 100% and the first light source outputs the second luminance, the light source driving current has a second current greater than the first current.

20. The method of claim 13, wherein the first light source is configured to output a gradually increasing luminance in the inactive period.

* * * * *